US009797250B1

(12) United States Patent
Akers et al.

(10) Patent No.: US 9,797,250 B1
(45) Date of Patent: Oct. 24, 2017

(54) SAFE HAVEN WALL

(71) Applicants: Harold Akers, Pikeville, KY (US); John George Blackburn, Pikeville, KY (US); Braden Lusk, Nicholasville, KY (US); Kyle Perry, Lexington, KY (US)

(72) Inventors: Harold Akers, Pikeville, KY (US); John George Blackburn, Pikeville, KY (US); Braden Lusk, Nicholasville, KY (US); Kyle Perry, Lexington, KY (US)

( * ) Notice: Subject to any disclaimer, the term of this patent is extended or adjusted under 35 U.S.C. 154(b) by 0 days.

(21) Appl. No.: 14/938,294

(22) Filed: Nov. 11, 2015

Related U.S. Application Data

(60) Provisional application No. 62/081,114, filed on Nov. 18, 2014, provisional application No. 62/120,606, filed on Feb. 25, 2015, provisional application No. 62/250,657, filed on Nov. 4, 2015.

(51) Int. Cl.
*E21F 11/00* (2006.01)
*E21F 1/14* (2006.01)
*E21F 17/103* (2006.01)

(52) U.S. Cl.
CPC ..... *E21F 11/00* (2013.01); *E21F 1/14* (2013.01); *E21F 17/103* (2013.01)

(58) Field of Classification Search
CPC ... E21F 11/00; E21F 1/14; E21F 1/145; E21F 17/103; E21F 17/12; E21F 1/10
USPC ..... 454/170, 171, 172, 168, 169
See application file for complete search history.

(56) References Cited

U.S. PATENT DOCUMENTS 2,729,064 A * 1/1956 Kennedy ..... E21F 17/103 299/11
4,815,363 A * 3/1989 Harvey ..... E21F 13/004 299/12
6,846,132 B2 * 1/2005 Kennedy ..... E21F 1/10 299/12
7,267,505 B2 * 9/2007 Kennedy ..... E21F 17/103 405/132
8,460,074 B1 * 6/2013 Akers ..... E21F 1/00 454/171
8,960,419 B2 * 2/2015 Kennedy ..... E21F 17/00 198/860.1
2011/0297057 A1 * 12/2011 Kennedy ..... E21D 21/00 109/79

OTHER PUBLICATIONS

Kyle A. Perry, et al.; Development of 15 PSI Safe Haven Polycarbonate Walls for Use in Underground Coal Mines; Final Report; pp. 1-92; University of Kentucky; U.S.A.; published at http://energy.ky.gov/resources/Documents/Forms/AllItems.aspx at least as early as Jun. 11, 2013.

Trackemas, et al.; Facilitating the Use of Built-in-place Refuge Alternatives in Mines; Department of Health and Human Services (DHHS), Centers for Disease Control and Prevention, National Institute for Occupational Safety and Health (NIOSH), Publication No. 2015-114, RI 9698; Apr. 2015; pp. 1-92; Office of Mine Safety and Health Research; Pittsburgh, PA; Spokane, WA; USA; www.cdc.gov/niosh.

* cited by examiner

*Primary Examiner* — David Bagnell
*Assistant Examiner* — Michael Goodwin
(74) *Attorney, Agent, or Firm* — Wyatt, Tarrant & Combs, LLP; Matthew A. Williams; Max E. Bridges

(57) ABSTRACT

A safe haven wall for use in defining a safe haven in an underground mine comprising a lower section and an upper section, wherein said upper section is slidingly engaged to the lower section.

7 Claims, 9 Drawing Sheets

SAFE HAVEN WALL

CROSS-REFERENCE TO RELATED APPLICATIONS

This application claims priority to and benefit from, under 37 C.F.R. §1.119(e), U.S. Provisional Patent Application Ser. No. 62/081,114 filed on Nov. 18, 2014; U.S. Provisional Patent Application Ser. No. 62/120,606 filed on Feb. 25, 2015; and, U.S. Provisional Patent Application Ser. No. 62/250,657 filed on Nov. 4, 2015. All applications are hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

This invention pertains to the field of mine safety and more specifically the provision of safe havens in underground mines to provide safe refuge for miners unable to escape their work area immediately after a disaster due to toxic gases or a blocked escapeway.

2. General Background of the Invention

In many mining disasters in underground mines, many miners survive the initial disaster only to lose their lives due to an inability to escape from or isolates themselves from poisonous gases that build up in the mine in the wake of the disaster. For example, in 2006, there were three major mining disasters involving fire or explosion. In these events, 19 miners lost their lives despite surviving the initial disaster.

In the wake of these 2006 disasters, the MINER Act (Mine Improvement and New Emergency Response Act of 2006) was enacted. As part of the mandate of the MINER Act, NIOSH was charged with researching refuge alternatives to determine what alternatives would provide the best protection for miners following a disaster. The primary function of a refuge alternative is to provide a safe haven for miners unable to escape their work area immediately after a disaster due to toxic gases or a blocked escapeway. To be effective, a refuge alternative must, at a minimum, survive the initial disaster. In addition, it would be beneficial if the refuge alternative would protect the miners from any secondary explosions. This research considered both built-in-place and portable refuge chambers (i.e. safe havens).

The research concluded that built-in-place alternatives were highly preferable. Such alternatives provide a superior environment to miners using them for refuge, which can beneficial to the health of the miners following a disaster. Such built-in-place alternatives also provide the ability to deliver an unlimited supply of breathable air through a borehole or a protected compressed air line, examples of the latter being the Hubble® Breathable Air Units (Models HBA 75, HBA 100, and HBA 250) that have been approved by MSHA for such use.

In an April 2015 NIOSH report[1] focused on facilitating the use of built-in-place safe havens, the authors noted that there were approximately 30 built-in-place safe havens in use in underground coal mines in the U.S.; none of which were capable of being relocated as the working face is advanced. The ability to relocate the safe haven is, however, highly desirable to keep the safe haven within the preferred distance from the working face of the mine. But the benefits of a built-in-place safe haven are so great, a 2007 report to Congress in the wake of the MINER Act advised that, if a built-in-place safe haven is used, permitting extended distance from the working face should be considered despite the obvious additional risks this would pose to miners, especially injured miners, in getting to the safe haven before the air available through the miner's self-contained self-rescuer is exhausted.

1 NIOSH [2015]. Facilitating the use of built-in-place refuge alternatives in mines. By Trackemas J D, Thimons E D, Bauer E R, Sapko M J, Zipf R K, Schall J, Rubinstein E, Finfinger G L, Patts L D, LaBranche N. Pittsburgh, Pa.: U.S. Department of Health and Human Services, Centers for Disease Control and Prevention, National Institute for Occupational Safety and Health, DHHS (NIOSH) Publication No. 2015-114, RI 9698.

Thus, it is clear that there is need for an apparatus that can be used to create the equivalent of a built-in-place safe haven in an underground mine that is also capable of being relocated as the working face of the mine advance. The present invention addresses this need. Unlike the known examples discussed above, the present invention is an adjustable height wall that can be assembled outside the mine and transported to the desired safe haven location at a lower cost than constructing a permanent wall in place. Once transported to the desired location in the mine, the wall of the present invention can be installed to create the equivalent of a built-in-place safe haven. Moreover, as the working face advances, the wall of the present invention can be relocated within the underground mine to keep the safe haven within the preferred distance from the working face. Thus, the present invention provides the equivalent of a built-in-place safe haven with all of the attendant benefits at a lower cost without the need to consider allowing it to be located further from the working face.

SUMMARY OF THE INVENTION

A safe haven wall for use in defining a safe haven in an underground mine comprising a lower section and an upper section, wherein said upper section is slidingly engaged to the lower section.

BRIEF DESCRIPTION OF THE DRAWINGS

For a further understanding of the nature, objects, and advantages of the present invention, reference should be had to the following detailed description, read in conjunction with the attached figures, wherein like reference numerals denote like elements and wherein.

DETAILED DESCRIPTION OF THE INVENTION

Figure 1:
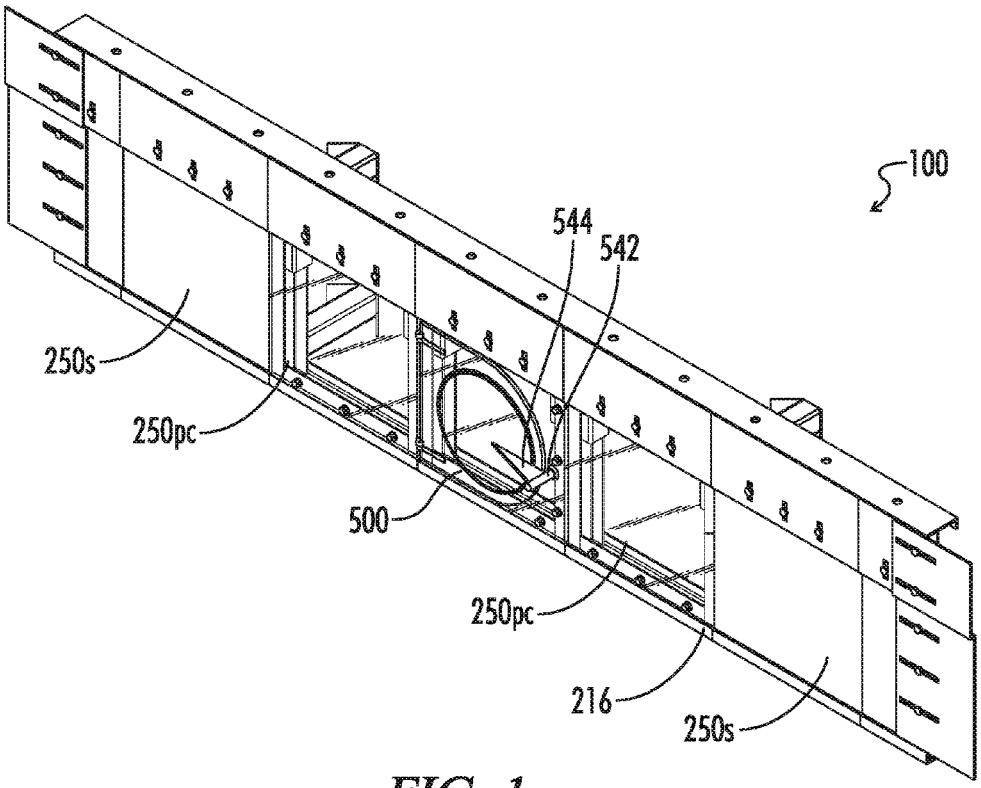
FIG. 1—is a perspective view of an embodiment of the invention.
Figure 2:
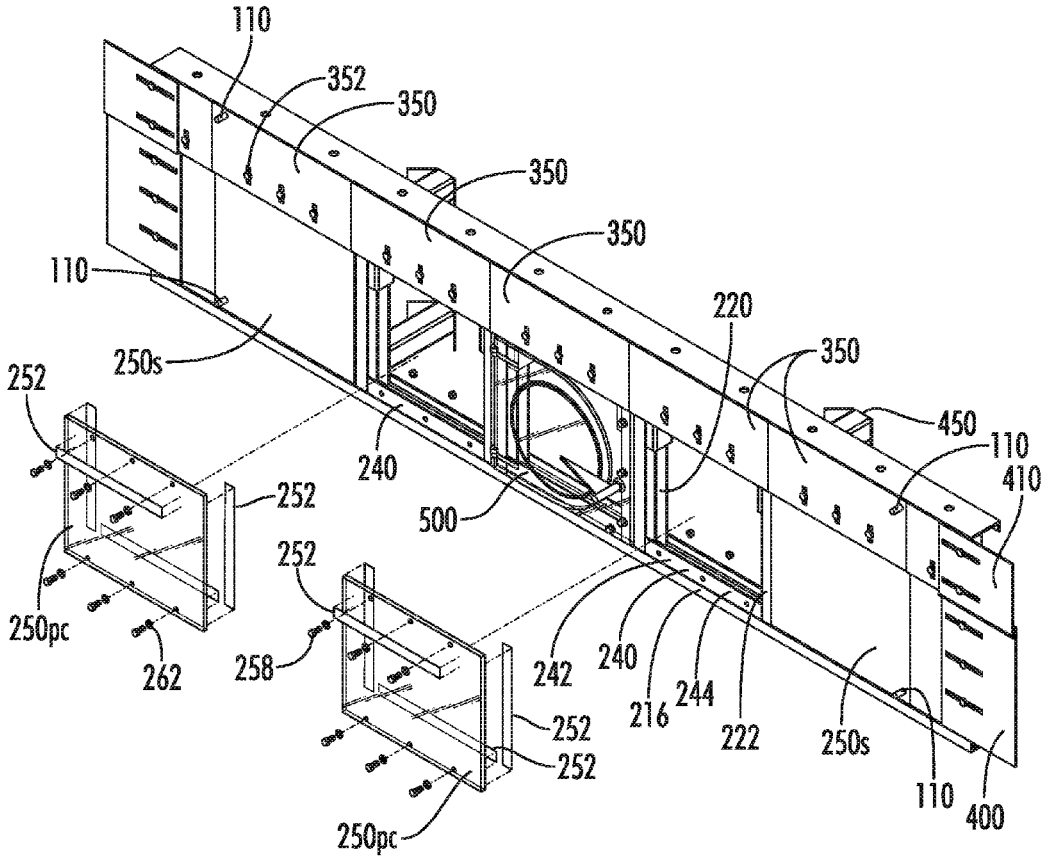
FIG. 2—is a partially exploded perspective view of an embodiment of the invention.
Figure 3:
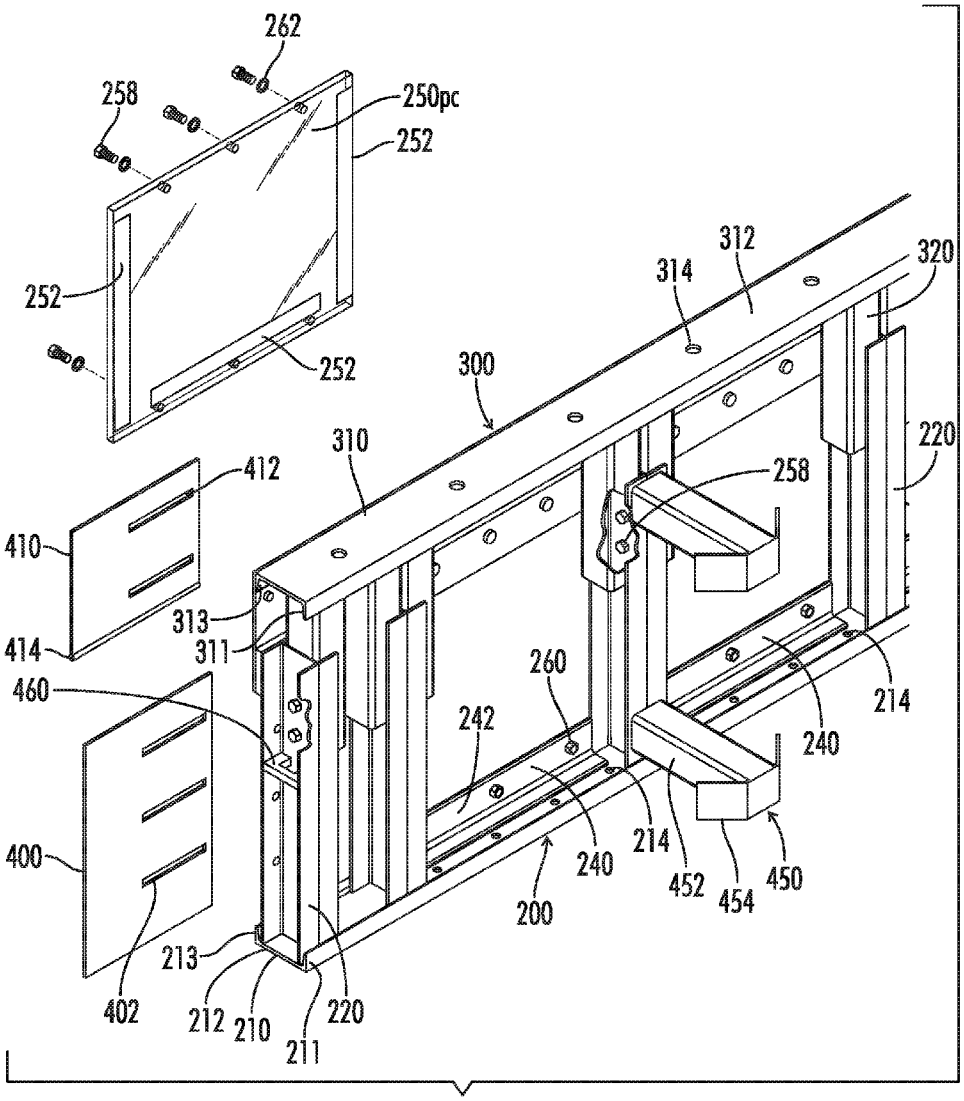
FIG. 3—is a partially exploded partial perspective view of an embodiment of the invention.
Figure 4:
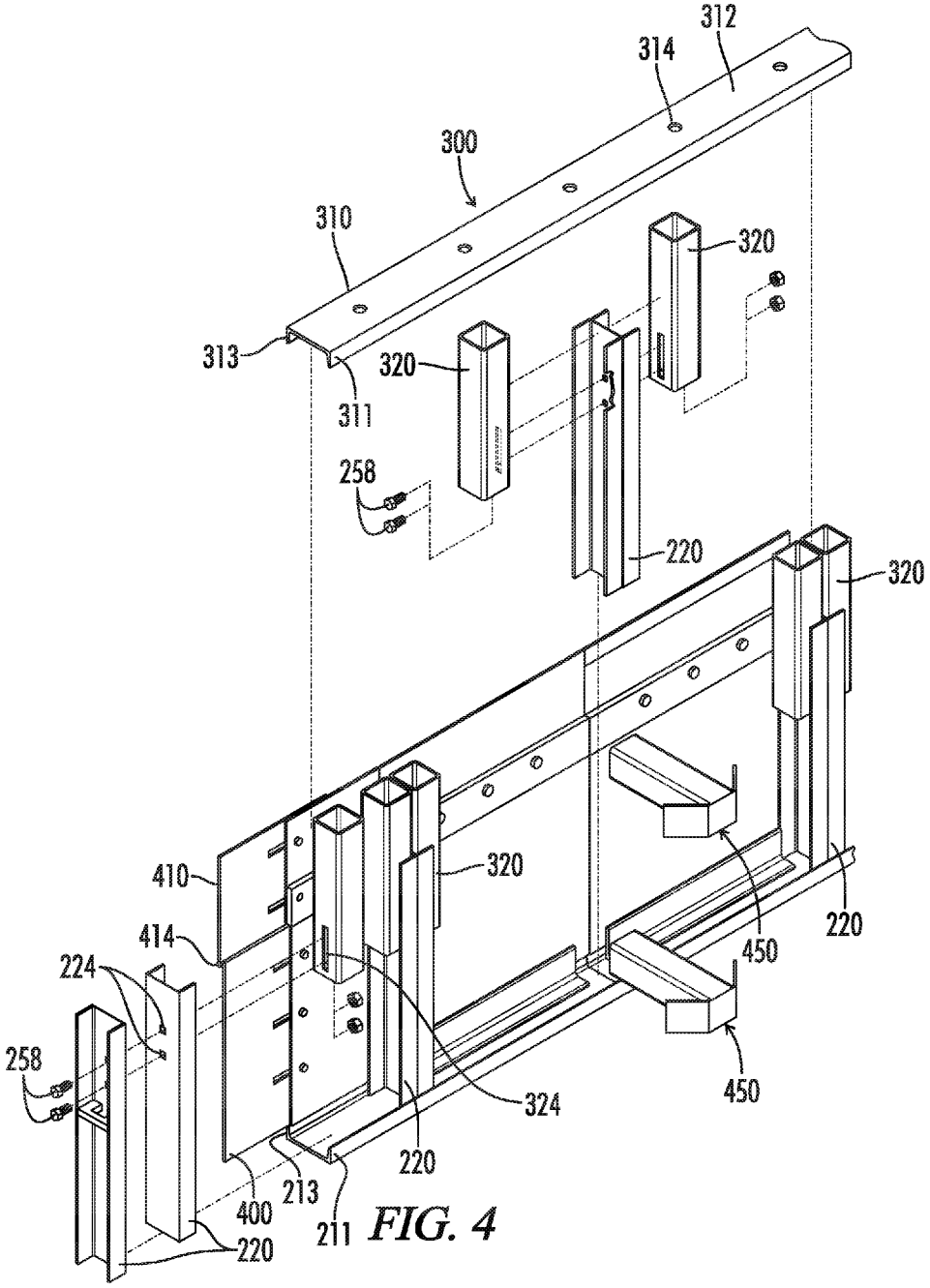
FIG. 4—is a partially exploded partial perspective view of an embodiment of the invention.
Figure 5:
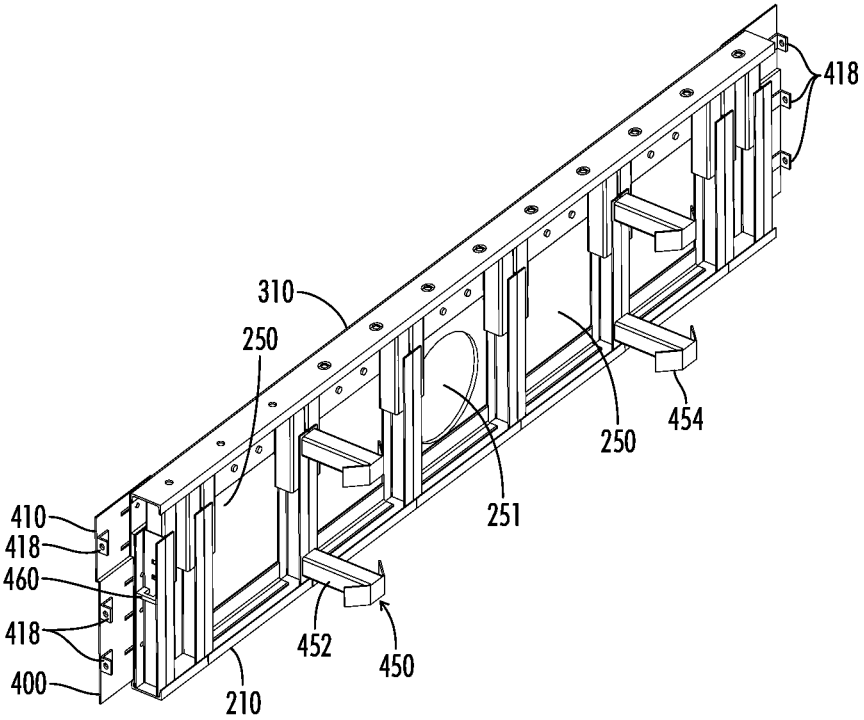
FIG. 5—is a perspective view of an embodiment of the invention.
Figure 6:
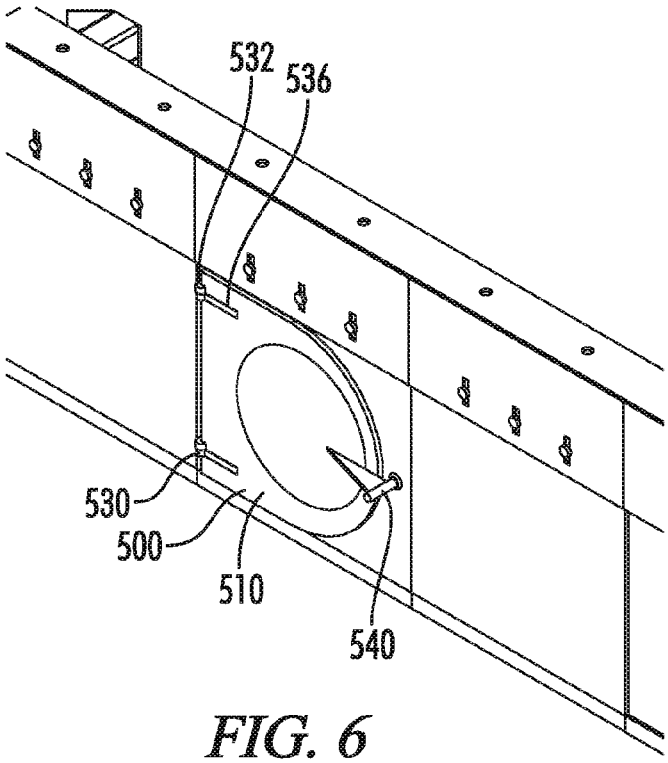
FIG. 6—is a partial perspective view of an embodiment of the invention.
Figure 7:
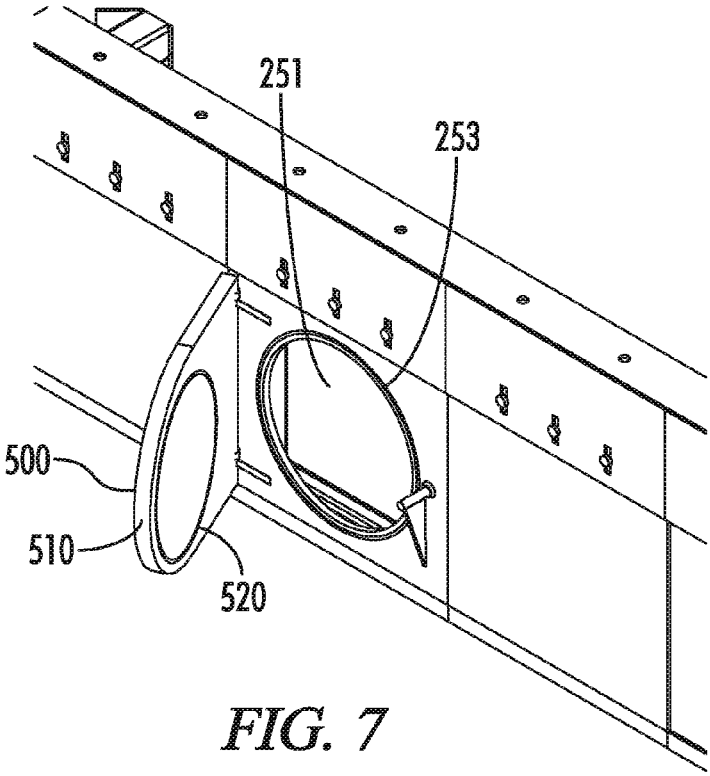
FIG. 7—is a partial perspective view of an embodiment of the invention.
Figure 8:
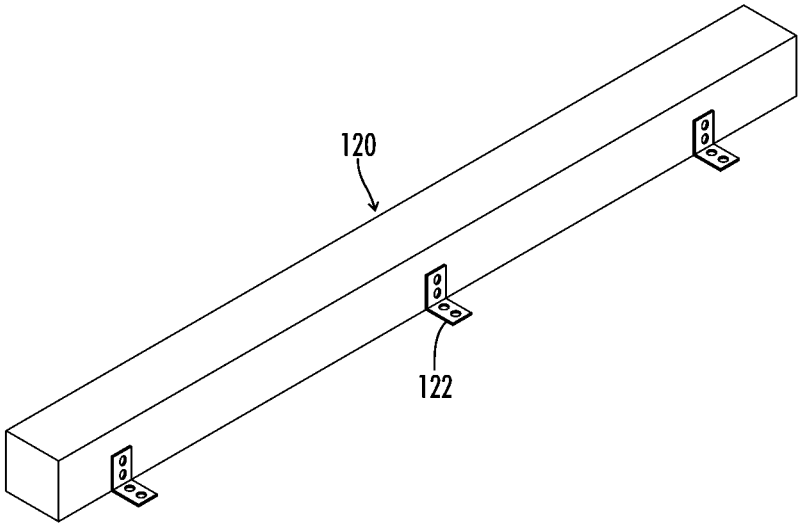
FIG. 8—is a perspective view of an embodiment of a base portion of the invention.

The present invention is safe haven wall 100 for use in underground mines to define an area within a mine in which miners and other personnel who are in the mine at the time of a catastrophic event such as an unplanned explosion or roof collapse can be safe when immediate egress is not possible. Safe haven wall 100 comprises lower section 200 and upper section 300. Lower section 200 and upper section 300 preferably comprise separate fabrications that are brought together at the mine to facilitate the movement of safe haven wall 100. One of the primary benefits of safe haven wall 100 is that it can be relocated within the mine after its initial installation or removed from the mine and installed in a different mine.

Lower section 200 comprises base plate 210, vertical members 220, angular base members 240, sheathing panels 250 and opposing end portions 211, 213. Base plate 210 may be formed from steel C-channel, where central portion 212 of the C-shape is placed adjacent to the mine floor across the opening to the safe haven and opposing end portions 211, 213 extend upwards. Defined in central portion 212 of base plate 210 are spaced apart apertures 214 to facilitate the bolting of base plate 210 to the mine floor across the opening to the safe haven or to base 120 if the additional height is required. The minimum spacing of apertures 214 is determined by the overall length and height of safe haven wall 100. In any event, the spacing is selected to ensure safe haven wall 100 can withstand a static pressure of 15 pounds per square inch ("PSI"). In a particular non-limiting embodiment in which the length of safe haven wall 100 is from nineteen to twenty-one feet, it is preferable to provide and utilize at least 14 equally-spaced apertures 214 to secure lower section 200 to the mine floor. It is also advantageous to utilize additional apertures 214 near the end portions of lower section 200.

In the illustrated embodiment, vertical members 220 are steel I-beams that extend upward from base plate 210. Vertical members 220 are affixed such that outer surface 222 of vertical member 220 will be adjacent upright portion 216 of base plate 210 that faces outward (i.e. away from) the safe have when safe haven wall 100 is in place. When base plate 210 and vertical members 220 are steel, welding is one method that can be used to affix vertical members 220 to base plate 210.

The spacing of vertical members 220 is selected based on the height of lower section 200 and the maximum overall height of safe haven wall 100 to ensure safe haven wall 100 can withstand a static pressure of 15 PSI. It is, however, preferable to space each pair of vertical members 220 to provide at least a 30-inch clear span to enable a stretcher to pass through the space between said pair of vertical members 220. An exception to this spacing is for vertical members 220 at the opposing ends of lower section 200. The height of vertical members 220 is less than the height of the mine ceiling at the desired construction location. In one embodiment, for use in a mine with a 51-inch ceiling, vertical members 220 are approximately 40 inches in height. Defined in the upper portion of vertical members 220 are apertures 224 that are parallel to safe haven wall 100 (where steel I-beams are used for vertical members 220, apertures 224 are defined in the web of the I-beam).

Angular base members 240 are affixed to base plate 210 such that one angular base member 240 extends between each pair of vertical members 220. In each case, upright portion 242 of angular base member 240 is adjacent to upright portion 216 of base plate 210 that faces outward (i.e. away from) the safe have when safe haven wall 100 is in place. Upright portion 242 of angular base member 240 has a height that is greater than upright portion 216 of base plate 210. This configuration results in outer surfaces 244 of upright portions 242 of angular base members 240 cooperating with outer surfaces 222 of vertical members 220 to form a plane for affixing sheathing panels 250. This also allows the edge portion of upright portion 216 of base plate 210 to function as a ledge upon which sheathing panels 250 can rest while it is being affixed to vertical members 220 and angular base members 240.

In the illustrated embodiment, sheathing panels 250 are comprised of two different materials: steel (sheathing panels denoted as 250*s*) and polycarbonate (sheathing panels denoted as 250*pc*). Sheathing panels 250 for a single installation could, however, be all of single material, including steel or polycarbonate, provided said material is capable of being affixed to vertical members 220 and base members 240 and capable of withstanding a static pressure of 15 PSI. Sheathing panels 250 are preferably affixed to the outward facing sides of vertical members 220 and angular base members 240. In the case of steel sheathing panels 250*s*, said affixation is preferably accomplished through welding.

In the case of polycarbonate sheathing panels 250*pc*, the panels may be affixed in a number of ways. One advantageous manner of attaching sheathing panels 250*pc* is the use of double-sided tape 252 such as 3M VHB Tape, which has the added benefit of forming an airtight seal. Another manner of affixing sheathing panels 250*pc* is with structural silicone (not shown) such as Tremco Spectrem 2, which also has the benefit of forming an airtight seal.

Instead of or as a supplement to the foregoing, sheathing panels 250*pc* may be affixed to vertical members 220 and angular base members 240 using bolts 258 that extend through apertures 256 that are held in place using nuts 260. Washers 262 are preferably between the head of bolt 258 and the outer surface of sheathing panel 250*pc* to evenly distribute the pressure exerted by the head of bolt 258. (Reference numbers 258, 260, and 262, are respectively used herein to identify bolts, nuts, and washers generally. One of skill in the art will, however, recognize that specific bolts, nuts, and washers may be selected for the various uses of bolts, nuts, and washers in connection with safe haven wall 100.)

Upper section 300 comprises ceiling plate 310, mating members 320, overlap plate 350 and opposing end portions 311, 313. Ceiling plate 310 may be formed from steel C-channel, where central portion 312 of the C-shape is placed adjacent to the mine ceiling across the opening to the safe haven and opposing end portions 311, 313 extend downwards. Defined in central portion 312 of ceiling plate 310 are spaced apart apertures 314 to facilitate the bolting of ceiling plate 210 to the mine ceiling. Apertures 314 may be aligned with apertures 214 in base plate 210. In any event, the spacing is selected to ensure safe haven wall 100 can withstand a static pressure of 15 PSI.

Mating members 320 are affixed to ceiling plate 310 and located to mate with vertical members 220 of lower section 200. In the illustrated embodiment, mating members 320 are formed from steel tubing have a generally rectangular cross section. The width of mating members 320 is selected to enable mating members 320 to slide within the channel of the I-beams used for vertical members 220. For outer vertical members 220, only a single mating member 320 is provided. For other vertical members, a pair of mating members 320 is provided. Where a pair is provided, mating members 320 forming the pair are spaced apart to accept the I-beam web of vertical member 220. Each mating member 320 is provided with slots 324 defined in the wall of the tubing adjacent to vertical member that generally align with apertures 224 defined in vertical members 220.

Overlap plates 350 are then affixed to the downward extending portion of ceiling plate 310 that faces outward (i.e. away from) the safe haven when safe haven wall 100 is in place. In the illustrated embodiment, overlap plates 350 are formed of steel. In such a case, welding is the preferred method of affixing overlap plates 350 to ceiling plate 310. In alternate embodiments, other types of fixation may be required. Defined in overlap plates 350 are slots 352. Slots 352 are arranged to align with apertures 252 in sheathing panels 250.

Lower section 200 and upper section 300 are mated together by aligning vertical members 220 and mating members 320. Upper section 300 is allowed to slide down until vertical members 220 are supporting ceiling plate 310, giving safe haven wall 100 a height that is less than the ceiling of the mine. Safe haven wall 100 is then transported to the location of the safe haven and placed across the opening to the safe haven. Jacks are then uses to elevate upper section 300 until ceiling plate 310 is adjacent to the ceiling of the mine. Base plate 210 and ceiling plate are then bolted to the mine floor and mine ceiling respectively using anchor bolts. Vertical members 220 and mating members are then bolted together using bolts 258 that pass through slots 324 in mating members 320 and apertures 214 in vertical members 220 that are aligned. Overlap plates 350 are then bolted to sheathing panels 250 utilizing bolts 258 that pass through slots 352 in overlap plates 350 and apertures 252 in sheathing panels 250 that are aligned. To form an airtight seal, expanding foam or pressurized grout bags or other MSHA approved sealant or other suitable fill material or a combination thereof may be used to address any unevenness in the mine floor or mine ceiling at the installation location. Alternatively, safe haven wall 100 may be placed on top of unfilled pressurized grout bags and unfilled pressurized grout bags are placed on top of safe haven wall 100 and between sliding panels 400 and 410 and the vertical walls of mine. Once upper section 300 is elevated into position adjacent to the mine ceiling, the pressurized grout bags are filled to create a seal around the perimeter of safe haven wall 100. Once the pressurized grout bags have cured sufficiently, safe haven wall 100 is anchored to the mine floor and mine ceiling.

Opposing ends of the wall 100 are provided with sliding panels 400 and 410 that can be adjusted to alter the length of the wall. Sliding panels 400 and 410 are preferably formed from steel. Sliding panel 400 is affixed to sheathing panel 250 at each end of wall 100 using bolts 258 that pass through apertures 406 in sheathing panel 250 and horizontal slots 402 in sliding panel 400. Sliding panel 402 is affixed to overlap plate 350 at each end of wall 100 using bolts 258 that pass through apertures 416 in overlap plate 350 and horizontal slots 412 in sliding panel 410. Sliding panel 410 may also be provided with rod 414 welded to a bottom portion of sliding panel 410 to reduce the gap between the inner surface of sliding panel 410 and the outer surface sliding panel 400, making it easier to form an airtight seal using expanding foam. The end portions of sliding panels 400 and 410 that will be adjacent to the mine walls may be provided with angle tabs 418 that can be used to bolt sliding panels 400 and 410 to the adjacent mine wall.

Figure 11:
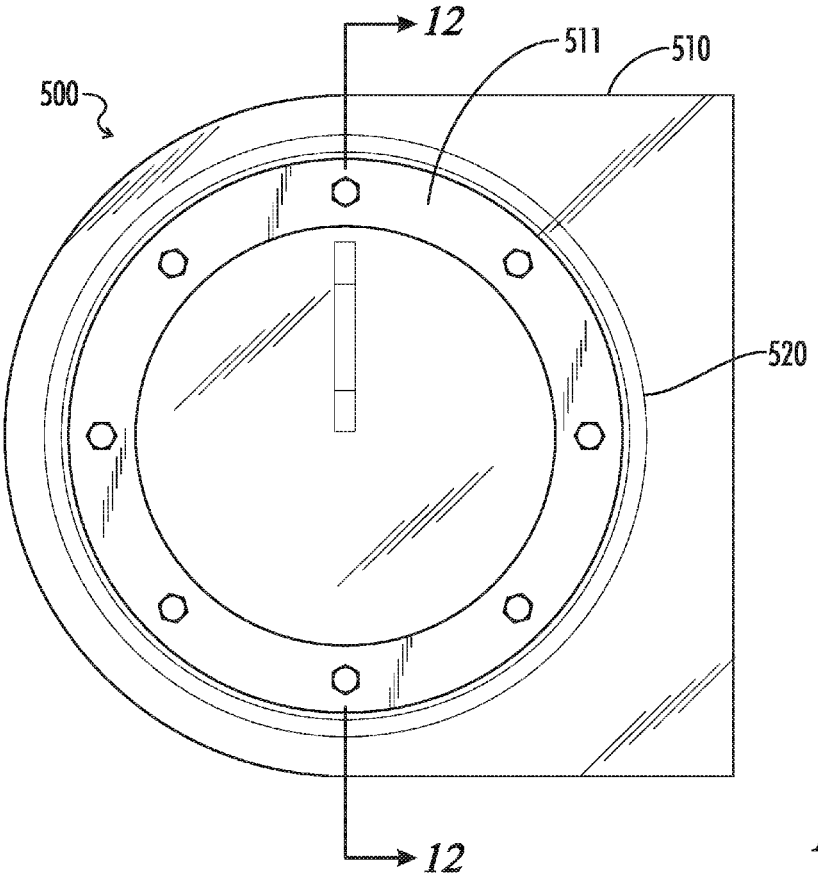
FIG. 11—is a front view of an embodiment of a hatch portion of the invention.
Figure 12:
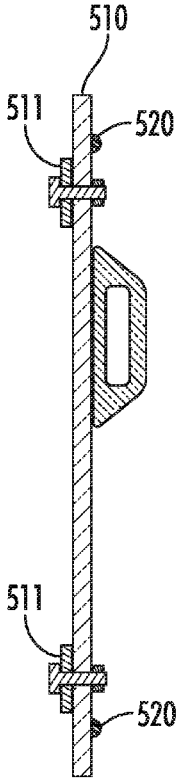
FIG. 12—is a cross-section view of the hatch portion of the invention from FIG. 11.

If needed, safe haven wall 100 may be configured to permit ingress and egress to a safe haven defined by safe haven wall 100 while still being able to create a positive pressure environment within the safe haven. In the illustrated embodiment aperture 251 is defined in sheathing panel 250 to permit such ingress and egress and hatch 500 is provided to form an airtight seal when it is in a closed position. In the illustrated embodiment, hatch 500 comprises door 510, gasket 520, hinges 530, and latching mechanism 540. Door 510 is a full overlay door that is larger than aperture 251. Gasket 520 is affixed to the inner facing surface of door 510 and forms a circle that is of a larger diameter than aperture 251. When door 510 is in its closed position, gasket 520 is received by circular groove 253, which is defined in the outer surface of sheathing panel 250 and surrounds aperture 251, to form an airtight seal. Steel plate 511 (show in FIGS. 11 and 12) may be used around all or a portion of the perimeter of door 510 to stiffen door 510 and prevent it from flexing when latched.

Hinges 530 are selected to enable door 510 to be parallel to sheathing panel **250*h* when door 510 is in its closed position without causing undue binding on the hinge side of door 510 and without causing door 510 to be distorted when latched in its closed position. In the illustrated embodiment, each hinge 530 further comprises hinge bolt 532 and hinge strap 536. Hinge bolt 532 is adapted on a first end to be bolted to vertical member 220 and that terminates at the opposing end in a hinge pin that extends perpendicularly to hinge bolt 532. Hinge strap 536 further comprises a loop for receiving the hinge pin and is adapted to be bolted to door 510**.

Hatch 500 is also provided with a latching mechanism to hold hatch 500 in its closed, airtight position. In the illustrated embodiment, latching mechanism 540 comprises rotatable shaft 542 that extends through vertical member 220. Affixed to the end of rotatable shaft 542 on the exterior side of safe haven wall 100 is latching member 544. Latching member 544 is position to engage the outer surface of door 510 when door 510 is in its closed position and to latch door 510 in its closed position. Affixed to the end of rotatable shaft 542 on the interior side of safe haven wall 100 is a handle that allows latching mechanism 540 to be rotated from the interior of the safe haven. Door 510 may also be provided with a handle (not shown) extending inward toward the safe haven to assist with holding door 510 in its closed positions as it is being latched. While the illustrated embodiment includes only a single latching mechanism 540, more than one may be included as deemed necessary to sufficiently latch door 510 in its closed positions. Where multiple latching mechanisms 540 are utilized, latching mechanism 542 may be adapted to extend through base plate 210, overlap plate 350, and/or ceiling plate 310 in similar fashion.

To facilitate movement of safe haven wall 100 within the mine, safe haven wall 100 may be provided with legs 450. Each leg 450 extends from the inward facing surface of one of vertical members 220. Each leg 450 comprises post portion 452 that, in the illustrated embodiment, is formed from rectangular steel tubing, but any material of suitable strength may be used. Foot 454 is affixed to the end of post portion 452. Foot 454 is preferably formed to facilitate sliding wall 100 through the mine to the location of the safe haven. In the illustrated embodiment, this is accomplished by forming foot 454 from a rectangular piece of steel plate having a width approximately equal to the width of post portion 452 and bending up the end portions of the steel plate that extend toward opposing ends of wall 100. Alternatively, foot 454 can have width greater than the width of post portion 452 with all edges bent upward to form a cup shape to facilitate sliding the wall laterally into and out of the entrance to the safe haven as well and longitudinally through the mine. To further facilitate the transport of safe haven wall 100 though the mine, each end of safe haven wall 100 may be provided with hitch 460.

Safe haven wall 100 may also be provided with a number of ports 110. In the illustrated embodiment, ports 110 are formed from circular pipe and sealed with threaded caps. Ports 110 enable cables, water lines, air supply lines, and the like to be extended through safe haven wall 100 and into the safe haven. One or more ports 100 can also be fitted with a one-way purge valve that will allow the atmosphere of the safe haven to be purged utilizing a continuous supply of fresh air from an external device such as the HUBBLE® breathable air unit. When a port 100 is opened to allow the insertion of cables, water lines, air supply lines, and the like, an airtight seal capable of withstanding a static pressure of 15 PSI can be achieved using expanding foam.

Figure 9:
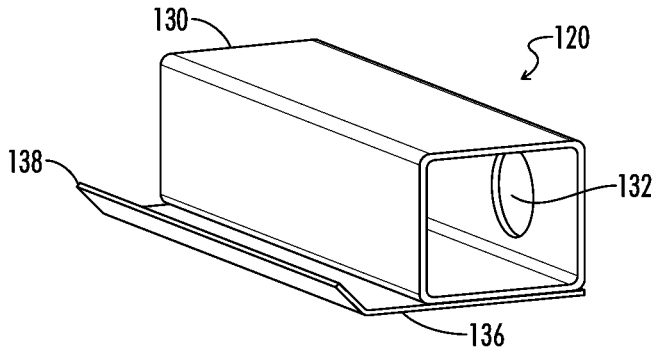
FIG. 9—is a perspective view of an embodiment of a base portion of the invention.
Figure 10:
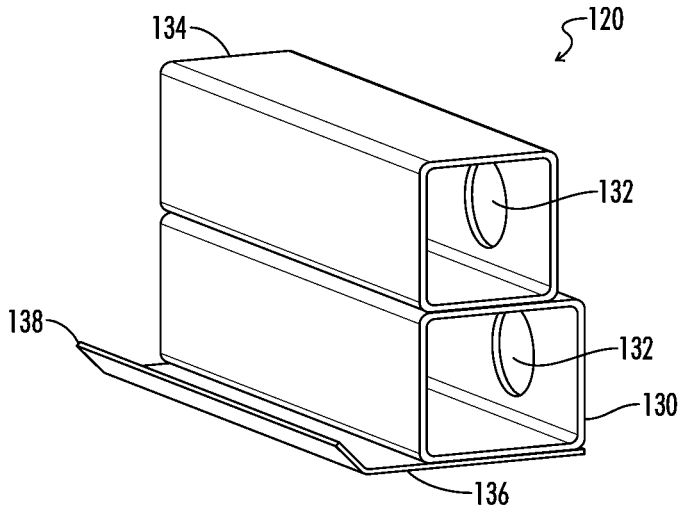
FIG. 10—is a perspective view of an embodiment of a base portion of the invention.

While the height of safe haven wall 100 can adapted for mines with different ceiling heights, safe haven wall 100 can also be mounted on base 120 if the ceiling height exceeds its maximum height. Base 120 can be formed as a rigid beam with sufficient resilience to withstand the weight of safe haven wall 100. While base 120 is illustrated as a solid block, base 120 may be constructed from other types of beam steel such as I beams, H beams, or box beams, tubing, or solid members such that the overall wall height is capable of withstanding as static pressure of 15 PSI. Base 120 must be secured to the mine floor in such a manner to allow it to withstand a static pressure of 15 PSI. One way this may be accomplished is by providing the inward side of base 120 with a plurality of angle brackets 122 that may be bolted to the floor of the mine. Safe haven wall 100 is bolted to the upper surface of base 120. As discussed above, it may be necessary to use expanding foam or pressurized grout bags or other suitable fill material or a combination thereof to form an airtight seal if the floor of the mine is not level and smooth. An alternative design of base 120 is shown in FIG. 9. In this design, base 120 is formed from hollow structural steel ("HSS") configured as rectangular hollow beam 130. If the rectangular cross-section has a pair of sides that are longer, the longer sides are attached to safe haven wall 100 and to the mine floor. In this configuration, one of the pair of sides that will be upright when base 120 is installed may be provided with apertures 132 to facilitate the bolting of hollow beam 130 to the mine floor and to safe haven wall 100. If additional height is required, an additional HSS beam 134 can be welded to the top of beam 130 as illustrated in FIG. 10. In this case, one of the pair of sides of both beam 130 and beam 134 that will be upright when base 120 is installed may be provided with apertures 132. In either case, or in the case of a solid beam, steel plate 136 may be welded to the bottom of beam 130 to provide an alternate means of bolting beam 130 to the mine floor. Steel plate 136 may also be provided with lip 138 to give base 120 a "sled-like" capability to facilitate movement of base 120.

To install safe haven wall 100, the first step is to determine the approximate measurements of the opening to be sealed. This will enable selection or fabrication of safe haven wall 100 that is best suited for the particular mine. It is generally advantageous to assemble lower section 200 to upper section 300 outside of the mine. Ceiling plate 310 and base plate 210 are predrilled for attaching safe haven wall 100 to the ceiling and floor (or base 120) respectively. To facilitate installation, a template with the hole patterns of ceiling plate 310 and base plate 210 can be used to enable the predrilling of the ceiling or floor of the mine. If predrilling is not done, the anchor locations can be drilled as part of the anchoring process once safe haven wall 100 is in place. Safe haven wall 100 is then transported to the installation location using hitch 460. Once safe haven wall 100 is at the installation location, it is tilted into place on the floor of the mine or base 120. If base 120 is used, it is first set in place across the opening to be sealed and anchored to the floor of the mine. Upper section 300 is then raised to be adjacent to the ceiling of the mine and anchored to the ceiling of the mine. Bottom wall 200 is attached to the floor of the mine or base 120 (this can be done simultaneously with anchoring upper section 300 to the ceiling of the mine). Vertical members 220 and mating members are bolted together using bolts 258 that pass through slots 324 in mating members 320 and apertures 214 in vertical members 220 that are aligned. Sliding panels 400 and 410 are then slid outward and bolted in place to engage the vertical wall portions of the mine adjacent to the ends of safe haven wall 100. When safe haven wall 100 is mounted on base 120, if base 120 is not the full width of the opening, it can be provided with separate sliding panels or sliding panel 400 can be extended downward the height of base 120. As the wall is installed and after installation, safe haven wall 100 can be sealed to the mine floor, ceiling, and sidewalls using pressurized grout bags, expanding foam, and similar known sealing materials that are approved for use in a mine. If grout bags are used, they can be put into place between the safe haven wall and the mine floor, wall, or ceiling and filled once the safe haven wall has been bolted in place. Once safe haven wall 100 is set in place, at least one fresh air line is installed through one of ports 110 and affixed to a regulator. At least one relief valve is installed in another of ports 110 to enable a positive pressure to be maintained within the safe haven defined by safe haven wall 100.

Attached hereto as Appendix 1 and incorporated by reference herein is a report prepared for submission to MSHA that further describes the invention. Attached hereto to as Appendix 2 and incorporated by reference herein is an installation manual with further details of the process for installing the safe haven wall in a mine.

It should be noted that this describes only the particular, illustrated embodiment. Those of skill in the art will recognize that other choices could be made for the various components of safe haven wall 100 without departing from the scope of the invention. For example, vertical members 220 could be formed from steel tubing and mating members 320 from a smaller cross-section tubing that would telescope in an out of vertical members 220.

The foregoing described embodiments are exemplary in nature and are not intended to limit the scope of the invention.

We claim:

1. A safe haven wall for use in defining a safe haven in an underground mine, said safe haven wall comprising:

a lower section, said lower section further comprising a base plate having a C-shaped cross section, wherein a central portion of the C-shape forms a bottom portion of said safe haven wall with opposing end portions of the C-shape extending upward, a plurality of vertical members extending upward from said base plate, each of said plurality of vertical members having an I-shaped cross section with a central portion, a top portion, and a bottom portion and each of said plurality of vertical members being located such that the top portion of the I-shape is adjacent to an inner surface of one of the upward extending end portions of said base plate that is on an outward facing side of the safe haven wall;

at least one angular base member extending between adjacent vertical members, each of said at least one angular base members having a first portion adjacent to an upper surface of a central portion of said base plate and a second portion adjacent to the inner surface of the upward extending portion of said base plate on the outward facing side of the safe haven wall that extends above the upward extending portion of said base plate;

at least one sheathing panel, a lower portion of said at least one sheathing panel located upon the upward extending portion of said base plate that is on the outward facing side of the safe haven wall and being affixed to an outer surface of two or more of said plurality of vertical members and an outer surface of the second portion of at least one angular base member;

an upper section, said upper section comprising a ceiling plate having a C-shaped cross section, wherein a central portion of the C-shape forms a top portion of said safe haven wall with opposing end portions of the C-shape extending downward, a plurality of mating members extending downward from said ceiling plate, wherein each of said plurality of mating members has a rectangular cross section, each of said plurality of mating members being located and sized to be received in channels formed by the central, top, and bottom portions of each of said plurality of vertical members;

at least one overlap plate, said at least one overlap plate being affixed to an outer surface of one of the downward extending end portions of said ceiling plate on the outward facing side of the safe haven wall such that when said upper section is engaged with said lower section, an upper portion of said at least one sheathing panel is located between an inner surface of said at least one overlap plate and an outer surface of said mating members; and at least one sliding panel extending from opposing end portions of said upper section and said lower section.

2. The safe haven wall of claim 1 further comprising a hatch to permit ingress to and egress from the safe haven.

3. The safe haven wall of claim 2 wherein said hatch further comprises:

an aperture defined in at least one of said at least one sheathing panel, said aperture sized to permit ingress to and egress by an individual from the safe haven;

a door, said door being a full overlay door affixed to said safe haven wall such that said door seals against an outer surface of said safe haven wall.

4. The safe haven wall of claim 3 wherein a gasket is a affixed to an inner facing surface of the door and a groove for receiving said gasket is defined in an outer surface of safe haven wall circumscribing said aperture.

5. The safe haven wall of claim 1 further comprising:

a plurality of legs, each of said legs extending from an inner facing surface of one of the plurality vertical members extending upward from the base plate and a foot affixed to an end portion of each of said plurality of legs.

6. The safe haven wall of claim 1 further comprising at least one port.

7. The safe haven wall of claim 6 wherein said at least one port further comprises a pipe extending through the safe haven wall, said pipe comprising two opposing end portions, and said pipe being adapted to receive a cap on each end portion of said pipe to enable said port to be sealed from inside or outside the safe haven.

* * * * *